United States Patent [19]

Pietroni

[11] 3,946,582

[45] Mar. 30, 1976

[54] DIESTOCK FOR WIREDRAWING

[75] Inventor: Piero Pietroni, Ascoli Piceno, Italy

[73] Assignee: Technofil S.p.A., Italy

[22] Filed: Oct. 23, 1974

[21] Appl. No.: 517,304

Related U.S. Application Data

[63] Continuation-in-part of Ser. No. 319,152, Dec. 29, 1972, abandoned.

[30] Foreign Application Priority Data

Dec. 31, 1971 Italy ..... 33198/71

[52] U.S. Cl. ..... 72/45; 72/286

[51] Int. Cl.² ..... B21C 9/00

[58] Field of Search ..... 72/39, 41, 43, 44, 45, 72/285, 286, 291, 467, 468; 269/166, 201

[56] References Cited

UNITED STATES PATENTS

| | | | |
|---|---|---|---|
| 769,830 | 9/1904 | Nehrbas | 269/201 |
| 1,835,462 | 12/1931 | Busey | 72/39 |
| 2,029,039 | 1/1936 | Simons | 72/43 |
| 2,203,751 | 6/1940 | Simons | 72/45 |
| 2,252,365 | 8/1941 | Fisher | 72/467 X |
| 2,336,771 | 12/1943 | Beaman | 72/467 X |
| 2,557,202 | 6/1951 | Raymond et al. | 269/201 |
| 3,526,115 | 9/1970 | Armstrong et al. | 72/45 |

FOREIGN PATENTS OR APPLICATIONS

| | | | |
|---|---|---|---|
| 130,412 | 1/1951 | Sweden | 72/285 |
| 1,123,030 | 3/1955 | France | 72/286 |

*Primary Examiner*—Milton S. Mehr
*Assistant Examiner*—E. M. Combs
*Attorney, Agent, or Firm*—Robert E. Burns; Emmanuel J. Lobato; Bruce L. Adams

[57] ABSTRACT

A wiredrawing diestock having wire inlet and outlet openings aligned coaxially with the a die aperture there-between. The diestock has a first chamber disposed around the wire inlet. It has a second chamber surounding the die. Several openings provide communication between the two chambers and allow the flow of liquids from the first to the second chamber. These latter openings have positions equally spaced from the axis of a wire being drawn through the wire inlet opening and the die. The openings have individual axes which converge at the axis of the wire at a point where the wire enters the die. The lubricating cooling liquid, fed under pressure to the first chamber, flows through these openings in streams having flow paths converging on the wire being drawn. The pressure of the liquid is maintained in the second chamber. Liquid can escape from that chamber only through the wire inlet and outlet openings, and these openings are largely filled by the wire passing through them. Preferably the diestock comprises a body which has two pivoted halves, capable of being opened and closed and housing the die therein.

4 Claims, 5 Drawing Figures

FIG. 3
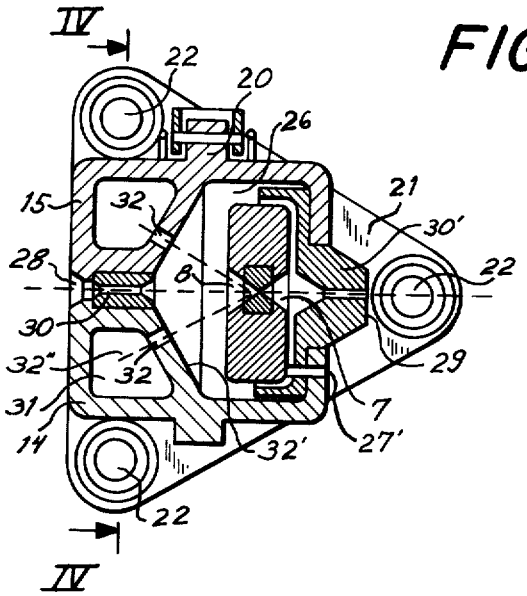
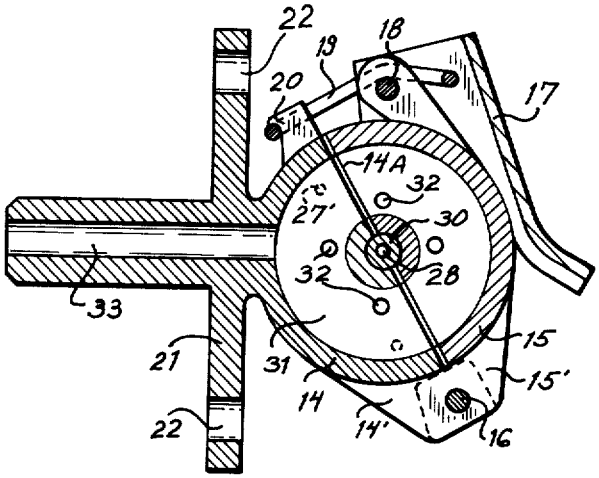
FIG. 4
FIG. 5
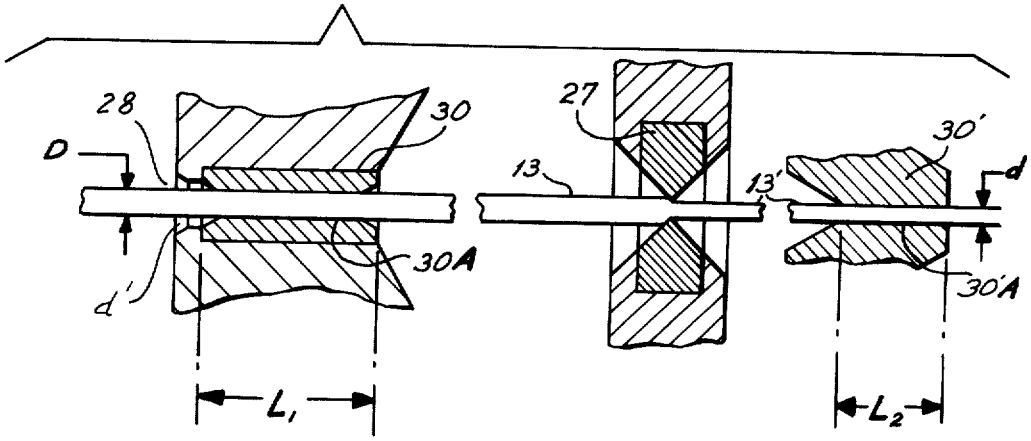

DIESTOCK FOR WIREDRAWING

BACKGROUND OF THE INVENTION

This is a Continuation in Part of the applicant's copending application Ser. No. 319,152 filed Dec. 29, 1972, now abandoned.

The present invention relates to a diestock for wiredrawing machines.

As is well known, wiredrawing machines are used to draw wires, commonly of metals such as copper, and to reduce them from an initial diameter or cross-section to a lesser, final diameter or cross-section. This is done by passing the wires through a suitable die. Practically wires are passed, once or repeatedly, through a series of diestocks, which at the same time expose the wire and the die to liquid for lubricating and cooling the surfaces of the wire and of the die. In order to insure a good wire drawing operation it is necessary to provide for efficacious application of the lubricating and cooling liquid to the die and wire surfaces and particularly to those surfaces in contact with one another. Moreover it is necessary to move the wire rapidly, relative to the die, in order to produce the ultimate thin wire economically.

Heretofore wire drawing machines have provided for lubrication and cooling of the metal wire by spraying an oil-water emulsion from the outside onto the diestock complex, comprising the die and the wire passing through it, or by immersing the diestock complex in an oil bath. The systems presently used and known are not free from drawbacks. The use of a diestock which is merely spray-cooled suffers from insufficient removal of heat, among other things.

Even with oil bath cooling and lubrication, the wire often is insufficiently cooled and lubricated, when it moves at a desirable, high speed. Additionally, rotary movements of wire drawing pulleys, in contact with the liquid, cause harmful movement of the liquid which result in turbulence and cavitation and thereby interfer with the desired contact between the wire and the die.

Adequate contact between the wire and the die has also been lost due to vibrations, in known wire drawing machines of the oil bath immersion type. Vibrations are generated by misalignment of the wire at the inlet and outlet of the diestock, relative to the die. Such misalignment in turn is caused by imperfect alignment of of the diestock relative to the drawing pulleys.

The technical problem to be solved is therefore that of providing a liquid immersed diestock which permits better lubrication and cooling, and more safely avoids the generation of vibrations than was possible in earlier machines.

OBJECTS AND SUMMARY OF THE INVENTION

It is an object of the present invention to provide a diestock which resolves the technical problem of earlier liquid immersed diestock machines.

For this purpose the invention provides for lubrication and cooling of the wire by forced circulation of lubricating and cooling liquid into and through a chamber, provided in the diestock, which chamber contains the die and wire inlet and outlet means properly aligned with the die. The lubricating and cooling fluid, which enters this chamber under pressure, can escape from this chamber only through very restricted areas, provided by the wire inlet and outlet openings of the diestock. These openings are almost entirely filled by the wire. For this purpose the wire inlet and outlet openings are dimensioned, respectively, to provide relatively close, preferably sliding fit, respectively, with the thick incoming wire and the thinner outgoing wire.

To insure proper orientation of the diestock relative to the wire drawing pulleys and to minimize vibrations of the diestock, the diestock according to the invention is mounted on elastic support means, by supporting fasteners which provide adjustable fastening of the diestock against the elastic support.

BRIEF DESCRIPTION OF THE DRAWING

In the attached drawings

FIG. 3 is a section taken along the section line III—III FIG. 2;

FIG. 4 is a section through the diestock taken along the line IV—IV FIG. 3 and

FIG. 5 is an enlarged detail from FIG. 3.

DESCRIPTION OF THE PREFERRED EMBODIMENTS

Figure 1:
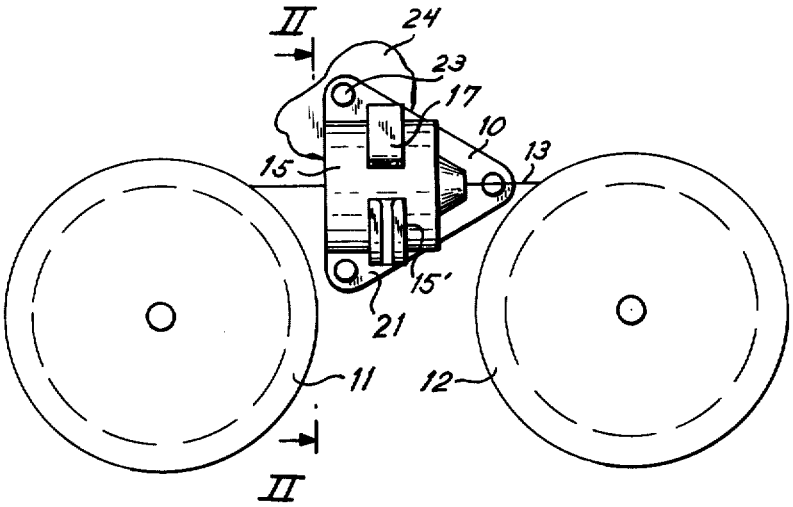
FIG. 1 is a side view of a diestock according to the invention.

As shown in FIG. 1 the diestock comprises a body 10 placed in a generally known manner between two drawing pulleys 11 and 12. Wire 13 travels from pulley 11 through the diestock to pulley 12. Both pulleys usually are rotatably driven and pulley 12 is driven at a higher speed than pulley 11. The speed is proportional to the degree of elongation of the wire, such elongation being encountered as the diameter or cross-section of the wire is reduced by the die in diestock body 10.

Figure 2:
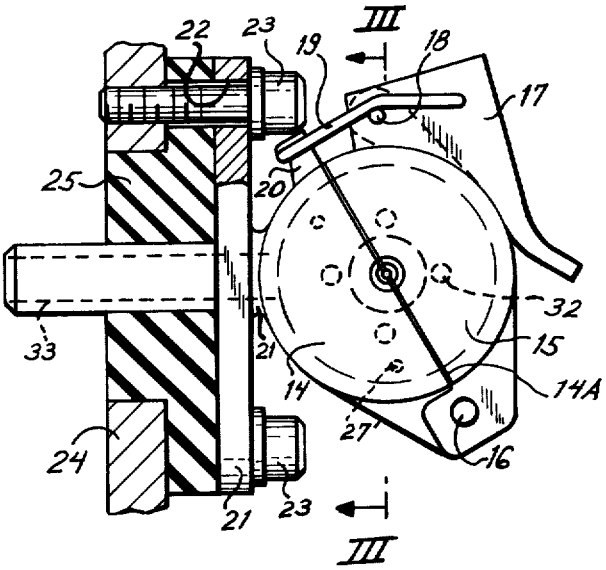
FIG. 2 is a sectional view of this diestock, taken along the section line II—II of FIG. 1.

As best shown in FIG. 2 the diestock comprises a hollow body which consists of the two half shells 14, 15. These half shells have outer projections 14' and 15' respectively, pivoted together at a pivot 16 so that the diestock 10 can be opened in order to insert a wire to be drawn, at the beginning of the operation of the machine. The two halves 14 and 15 are kept in a closed position, with a gasket 14A between them. Closure is achieved by a closing device which comprises a control lever 17, pivoted at a pivot 18 to the half section 15. This lever is provided with a hook 19 disposed to grip a tongue 20 which projects from the other half section or half shell 14 of the diestock.

The body of the diestock, as illustrated, is mounted on a mounting plate 21, by bracket means 21'. Holes 22 in the mounting body 21 are disposed for receiving mounting screws 23 to fix the plate 21 to the supporting structure 24 of a wire drawing machine. An elastic body 25 for example of neoprene or synthetic rubber, is interposed between plate 21 and supporting structure 24. This arrangement permits adjusting the diestock and aligning it with wire pulley 11 and 12, by tightening or loosening the mounting screws 23 as required. The elastic body 25 also provides an elastic seat for the diestock, thereby dampening the transmission of vibrations of the diestock to the wire drawing machine structure 24.

According to the invention and as best shown in FIGS. 3 and 4 the shells 14 and 15 of the diestock body or housing define there-between a main die chamber 26, which is normally filled with liquid under pressure. In this chamber there is provided a die 27, well known per se. This die 27 can be mounted for example, in the lower half shell 14 by pins 27'. The die 27 is aligned with an inlet port 28 through which the wire 13 to be drawn enters the die chamber 26 FIGS. 3, 5 and also with an outlet port 29 for removing the drawn wire from the die chamber (FIG. 3). These ports 28 and 29 are defined by end portion of wire inlet and outlet bushings or fittings 30, 30', respectively. These bushings or fittings are seated in the lower half shell 14 (FIGS. 3, 4) and have, respectively, bores or openings 30A and 30'A (FIG. 5).

The die 27 advantageously has an input cone 8 and output cone 7 (FIG. 3) both having surfaces exposed in and to the liquid-containing pressure chamber 26, and coaxially aligned with the wire inlet and outlet openings 30A, 30'A (FIG. 5).

As shown in FIGS. 3 and 5 the actual length $L_1$ of the inlet opening 30 as well as the axial length $L_2$ of the outlet opening 30' is for example from 8 to 15 times the initial diameter of the wire, present in opening 30. This arrangement has a number of advantages in accordance with the invention, including the fact that it permits accurately guiding the wire with respect to the inlet and outlet cones 7, 8 of the die 27. Moreover, as best shown in FIG. 5, the effective clearance *d'* of the inlet and outlet openings 30 and 30' is kept very restrictive. These features enable the desired use of pressurized fluid in the chamber 26, as will be described hereinafter.

Concentrically with and around the inlet opening 30A for the wire 13 in the wire drawing body 10, a second annular chamber 31 is provided. This chamber communicates with the main die chamber 26, through suitable holes 32 disposed in the separating wall 32' between the chambers 31 and 26. Cooling and lubricating liquid under pressure enters chamber 31 through a duct or passage 33. It then passes from chamber 31 into chamber 26 through the holes 32. The fluid may be for example a lubricating oil emulsified with water.

As best shown in FIG. 3 the holes 32 are equally spaced from the die 27 and are arranged symmetrically thereto. They have axes 32' which are inclined so that they point toward, and converge in, the apex of inlet cone 8 of the die 27. Thus the liquid passing from the chamber 31 to the chamber 26 is directed against a surface of the wire 13 at the point where this wire passes into the die 27. This directed, convergent feed of liquid streams under pressure results in optimum lubrication and cooling of the wire and die surfaces.

The lubricating and cooling liquid ultimately leaves the diestock 10 at the front and rear thereof through such little clearance *d'* as the wire inlet and outlet openings 28, 29 provide, around the wire 13 and 13' (FIG. 5). On the outside of the diestock the ultimately leaving liquid can be collected by suitable means, not shown.

The net clearance *d'* for liquid flow, around wire 13, 13', in openings 30A, 30'A is extremely small as each of these openings has an overall clear diameter which closely corresponds to the diameter D,*d* of the respective (original and drawn) portions of the wire. Advantageously the wire has sliding fit in these openings 30A, 30'A.

As previously noted, these openings have a length ($L_1$ and $L_2$ respectively) which equals several times the overall clearance of the openings. Thus their length equals many times the net clearance of the openings, restricted by the wire.

A high back pressure of the liquid is thereby substantially maintained in the main die chamber 26, although escaping liquid ultimately reaches atmospheric pressure, outside of this chamber.

Excellent results of the lubrication and cooling of the wire and the die have been obtained with the new device. This has been established by tests carried out with this new device. In the tests the lubricating and cooling fluid was kept at a pressure of 4 to 6 kg/cm$^2$, in the chamber 26.

I claim:

1. A diestock for wire drawing, comprising:

a die having an inlet cone receptive of a wire of a first diameter and having an outlet cone disposed to discharge the wire thinned to a second and smaller diameter by drawing it through the die;

a housing which encloses and fixedly supports the die and defines a die chamber around the die in which the die and its inlet and outlet cones are exposed;

means for keeping the die chamber filled with pressurized, cool lubricant liquid by feeding such liquid into the die chamber to keep the die and both the exposed inlet and outlet cones thereof immersed in such liquid; and means defining restricted, elongate wire inlet and outlet openings in the housing, opposite to and axially aligned with the inlet and outlet cone, respectively, said wire inlet and outlet openings providing the only communication, in the use of the diestock for wire drawing, between the die chamber and the space outside the housing, said wire inlet and outlet openings having sliding fit, respectively, with the wire of the first diameter and with wire thinned to the second and smaller diameter, each of said wire inlet and outlet openings being elongate to extend over a length substantially greater than the respective diameter of the wire, thereby providing a path for the pressurized liquid outwardly from the die chamber only through the narrowly restricted spaces left by said sliding fit of the wire in said inlet and outlet openings to keep the liquid under substantial back pressure in the die chamber.

2. A diestock according to claim 1 in which the means for feeding pressurized liquid to the die chamber comprises an annular chamber receptive of the pressurized liquid and discharging the liquid into the die chamber in a plurality of streams distributed circumferentially of the annular chamber and symmetrical to the die.

3. A diestock according to claim 2 in which the annular chamber has a wall in common with the die chamber and defining a plurality of holes to discharge the streams, said holes being equally spaced from the die and having axes convergent on the apex of the inlet cone of the die.

4. A diestock according to claim 1 in which the means defining restricted elongate wire inlet and outlet openings comprise a wire inlet bushing and a wire outlet bushing, both inserted in said housing and each defining one of said narrowly restricted spaces.

* * * * *